US005782273A

United States Patent [19]

Moser et al.

[11] Patent Number: 5,782,273

[45] Date of Patent: Jul. 21, 1998

[54] DUAL LACING WIRE MECHANISM FOR A COIL SPRING ASSEMBLY MACHINE

[75] Inventors: Terry W. Moser; John B. Schnake; Thomas J. Wells, all of Carthage, Mo.

[73] Assignee: L&P Property Management Company, South Gate, Calif.

[21] Appl. No.: 822,115

[22] Filed: Mar. 21, 1997

[51] Int. Cl.[6] ..... B21F 33/04

[52] U.S. Cl. ..... 140/92.4; 140/3 CA; 140/92.93

[58] Field of Search ..... 140/3 CA, 92.3, 140/92.4, 92.6, 92.7, 92.9, 92.93, 92.94

[56] References Cited

U.S. PATENT DOCUMENTS 1,817,087 8/1931 Lofman .
1,952,413 3/1934 Brandwein .
2,765,815 10/1956 Gauci .
3,122,177 2/1964 Kamp .
3,503,115 3/1970 Kirchner .
3,541,828 11/1970 Norman .
3,736,784 6/1973 Felker .
3,774,652 11/1973 Sturm .
4,445,547 5/1984 Aronson .
4,553,572 11/1985 Zapletal et al. .
4,686,753 8/1987 Zapletal et al. .

*Primary Examiner*—Lowell A. Larson
*Attorney, Agent, or Firm*—Wood, Herron & Evans, L.L.P.

[57] ABSTRACT

A coil spring assembly machine for lacing coil springs together to form a coil spring assembly, which machine includes clamping jaws for clamping together portions of adjacent rows of coil springs in at least one of a top and bottom plane of the coil spring assembly, which clamping jaws include dies which cooperate with the end portions of the rows of coil springs to define a helical travel path for helical lacing wires as those lacing wires are moved through the helical travel path. The machine further includes a lacing wire forming and application mechanism for alternatively and selectively supplying lacing wires having two different physical characteristics to that helical travel path.

15 Claims, 6 Drawing Sheets

DUAL LACING WIRE MECHANISM FOR A COIL SPRING ASSEMBLY MACHINE

This invention relates to coil spring assembly machines and, more particularly, to a lacing mechanism for securing rows of coils of a spring core together in a coil spring assembly machine.

BACKGROUND OF THE INVENTION

It is well known in the prior art to fabricate a coil spring assembly or spring core by connecting rows of adjacent coil springs of that assembly together through use of helical lacing wires. Such coil spring assemblies are often used to form the spring cores for innerspring mattresses. In this product environment, the coil springs of adjacent spring rows are connected together by helical lacing wires in the top and bottom planes of the assembly.

In a typical assembly machine of this type, each of an upper and lower spiral lacing wire is initially formed by one of a pair of forming heads of a lacing wire forming apparatus and is thereafter caused to wind or travel or lace its way from one side edge of the coil spring assembly toward the other side edge thereof for connecting together adjacent spring rows of the assembly. Coil spring assembly machines which function to assemble adjacent spring rows into an interconnected coil spring assembly are illustrated, for example, in U.S. Pat. Nos. 3,774,652 and 4,686,753. Lacing wire forming apparatus which takes a spring wire and coils it into a lacing spiral configuration and thereafter causes that lacing spiral to wind and travel or lace its way from one side edge of the coil spring assembly toward the other side edge thereof is disclosed in one or more of U.S. Pat. Nos. 3,122,177; 3,503,115; 3,541,828; and, 3,736,784.

In pending patent application Ser. No. 08/631,841, filed Apr. 10, 1996, now U.S. Pat. No. 5,669,087, and assigned to the assignee of this application, there is disclosed a novel mattress spring assembly wherein the assembly is posturized or zoned throughout the length of the spring assembly by means of lacing wires of differing physical characteristics, such as differing gauge wires. As disclosed in this pending application, by utilizing lacing wires of differing physical characteristics as, for example, differing gauge wire, it is possible to form zones of differing firmness throughout the length of the mattress, or if the lacing wires extend longitudinally, adjacent the edges of the spring assembly. To date, and until the invention of this application, though, there has been no machine or mechanism for applying lacing wires of differing physical characteristics to a common spring assembly. Heretofore, the mechanisms for applying lacing wires to spring assemblies have always applied lacing wires of identical or substantially identical configuration and physical characteristics to the spring assembly, and the equipment for such application was incapable of automatically switching from one lacing wire to a different lacing wire of a differing physical characteristic, such as a differing gauge wire.

It has therefore been an objective of this invention to provide an improved lacing mechanism for a coil spring assembly machine which is automatically capable of switching and sequentially applying lacing wires of differing physical characteristics to a single or common spring assembly so as to vary the firmness of the spring assembly over its surface.

Still another objective of this invention has been to provide a variable lacing wire application machine which is economical to manufacture and operate and which minimizes floor space for the lacing wire application portion of the assembly machine.

SUMMARY OF THE INVENTION

To accomplish these objectives, the invention of this application comprises a coil spring assembly machine for lacing coil springs together to form an assembly, which machine includes clamping jaws for clamping together end portions of adjacent rows of coil springs in at least one of a top and bottom planes of the coil spring assembly, which clamping jaws include dies which cooperate with the end portions of the coil springs to define a helical flow path for helical lacing wires as those lacing wires are moved through the helical travel path, and a lacing wire forming mechanism for selectively supplying lacing wires having at least two differing physical characteristics to that travel path. Because the helical lacing wires so applied have differing physical characteristics, such as being formed from differing gauge wire, the resulting coil spring assembly has a surface in that top or bottom plane which is zoned to be of differing firmness over the surface of the spring assembly. For example, if heavier gauge wire is used to lace the central portion of the coil spring assembly and a lighter gauge wire is used to lace the end portions, the central portion or zone will be of greater firmness than the end zones.

DETAILED DESCRIPTION OF THE DRAWINGS

These and other objects and advantages of this invention will become more readily apparent from the following description of the drawings, in which.

Figure 1:
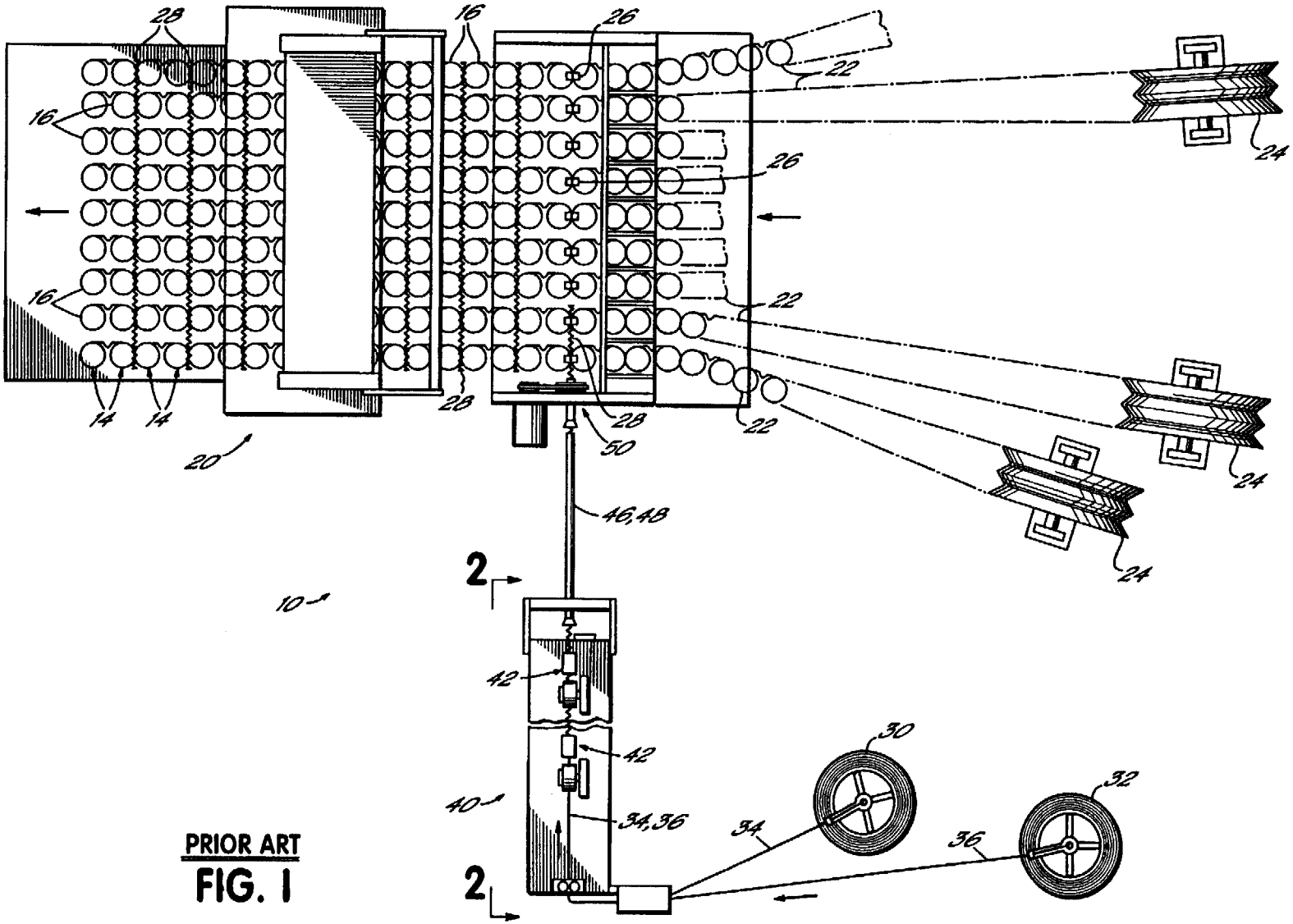
PRIOR ART FIG. 1
FIG. 1 is a top plan view of a prior art coil spring assembly machine.
Figure 2:
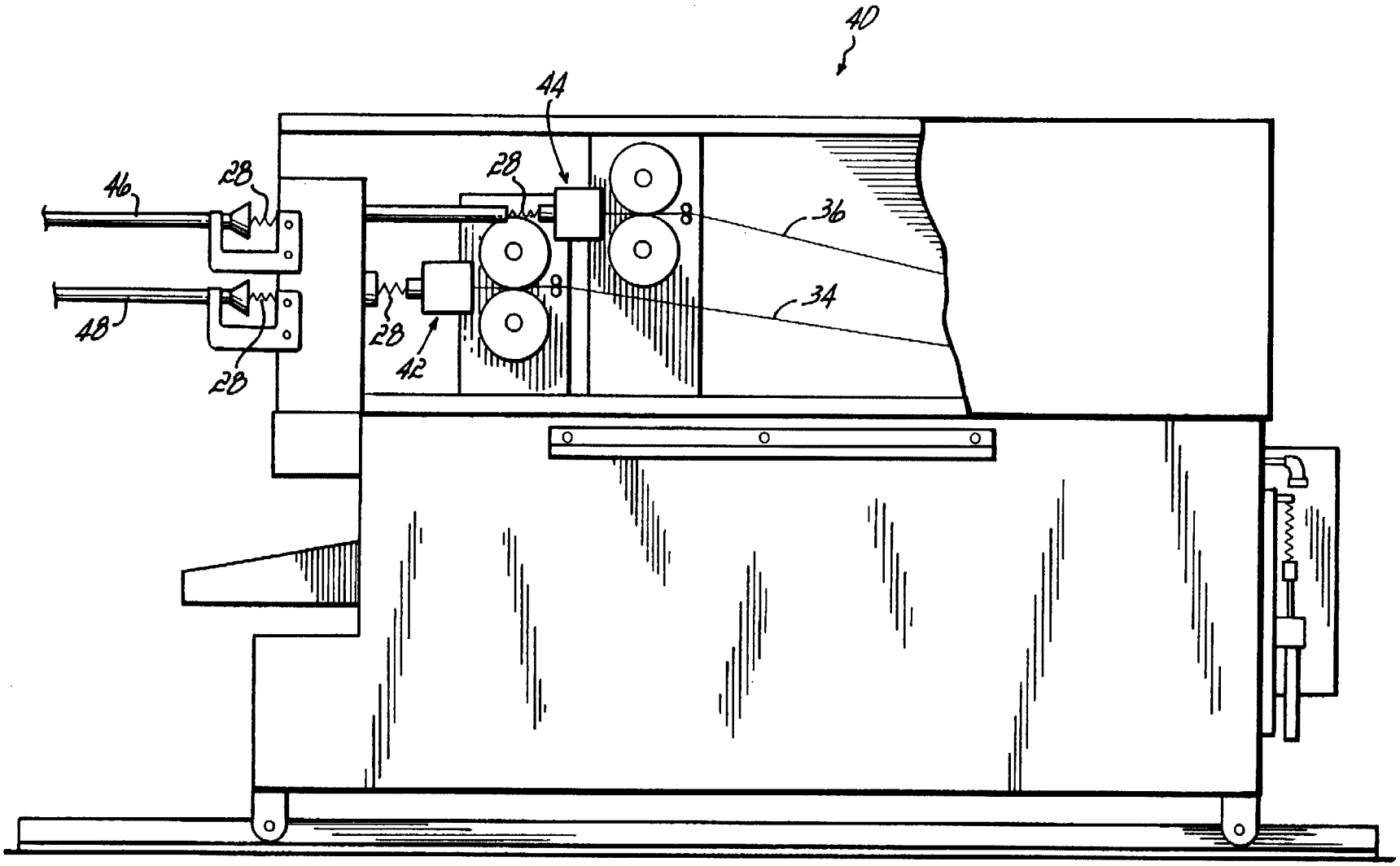
PRIOR ART FIG. 2
FIG. 2 is a side elevational view of the lacing wire forming portion of the prior art machine of FIG. 1.

With reference to FIGS. 1 and 2, there is illustrated a conventional prior art transfer and assembly machine 10 for assembling multiple rows 14 of coil springs 16 into an assembled innerspring unit 20. The particular transfer and assembly machine 10 illustrated in FIGS. 1 and 2 is operable to assemble an innerspring unit 20 made from continuous bands 22 of springs which extend longitudinally of the innerspring unit 20. These continuous bands 22 of springs are supplied to the assembly machine from long continuous rolls 24 of such bands. Within the assembly machine 10, these bands of springs 22 are clamped by clamping dies 26 in the top and bottom planes of the spring assembly, and while so clamped, helical lacing wires 28 are fed to and through the clamping dies 26 which, together with the clamped springs, form a helical flow path for the helical lacing wires 28 as those wires are fed through the clamping dies. After a pair of helical lacing wires 28 in the top and bottom planes of the innerspring units are fed to and through the clamping dies 26, at least one end of the lacing wire is turned back upon itself to prevent the lacing wire from unwinding from the laced springs. The dies 26 are then opened and the spring assembly indexed to supply the next following row of coil springs to the clamping dies 26 after which the process is repeated to thread a pair of helical lacing wire over the end turns or end portions of the next row of coil springs. After an appropriate number of rows of coil springs have been laced together by the helical lacing wires 28, a cutter mechanism is operative to cut the connection between adjacent rows of coil springs so as to create a completed innerspring assembly 20 ready for supply to a border rod application machine or a mattress assembly machine.

While the prior art machine has been illustrated and described as one for assembling innerspring units 20 made from rows of continuous springs, the machine could as well form assembled units from individual knotted or unknotted coil springs in which event the springs would be supplied to the assembly machine by a conventional transfer mechanism in lieu of rolls of continuous springs.

In order to create the helical lacing wires preparatory to supply to the assembly machine, appropriate gauge wire is supplied from pay-off reels 30, 32 to a helical wire forming mechanism 40. This mechanism 40 is operative to accept substantially straight wire 34, 36 from the pay-off reels 30, 32 and to form that wire within forming heads 42, 44 into a helical configuration. That helically configured wire 28 is fed from the forming heads 42, 44 of the forming mechanism 40 into top and bottom helical delivery tubes 46, 48. After an appropriate length of helically formed wire has been fed into the tubes, the helical wire is cut to length by a cutter mechanism (not shown) located on the front of the helical wire forming mechanism 40. The cut to length helical wire 28 is then stored in the delivery tubes 46, 48 until the assembly machine has clamped the adjacent rows of unclamped coil springs 14. Upon closing of those clamps 26, an auxiliary helical feed mechanism 50 is operative to drive the helical lacing wires from the delivery tubes 46, 48 into and through the clamping dies 26 and over the clamped end turns or end portions of the coil springs 16.

So much of the machine as has been described hereinabove is conventional and well known to the trade. One such machine suitable for this application is a Wells Automatic Unit Assembler manufactured and sold by Frank L. Wells Company of Kinosha, Wis.

With reference now to FIGS. 3, 4, 5, 6, 7 and 8, there is illustrated the invention of this application. The transfer and assembly machine illustrated in FIGS. 3, 4 and 5 have many components which are the same or substantially the same as the transfer and assembly machine illustrated and described hereinabove with reference to FIGS. 1 and 2. To the extent that the two machines contain components or assemblies which are identical or substantially identical, those components or assemblies have been given the same numerical designation in FIGS. 3–5 as were given to the machine of FIGS. 1 and 2, but followed by a prime (') sign in FIGS. 3–5.

In accordance with the practice of the invention of this application, the spring unit or spring core 20' is separated into a plurality of regions or zones, each region or zone being of differing firmness due to different physical characteristics of the helical lacing wires 28', **28*a* within that region of the spring core. The springs 16 or rows of springs 14 which make up the spring core are identical in all regions of the spring core and in no way contribute to the differing firmness of the regions. Each spring 16 has an upper face in an upper plane and a lower face in a lower plane with a plurality of helical turns or revolutions between the upper and lower faces of the spring. The springs 16 may be conventional knotted or unknotted coil springs or continuous bands of springs, but in any case, the springs 16 are arranged in side-by-side rows and columns. Adjacent rows 14 of springs 16 are connected together by helical lacing wires 28', 28*a* in both the upper and lower planes, respectively, such that the helical lacing wires encircle a portion of the upper and lower faces of the springs (see FIGS. 5 and 6). The helical lacing wires 28', 28*a* of the spring core 20'** are of differing characteristics within the different regions of the spring core. These differing characteristics impart a differing firmness to the different regions or zones of the mattress spring core, all as clearly illustrated and described in the assignee's own pending U.S. patent application Ser. No. 08/631,841, filed Apr. 10, 1996, the disclosure of which is hereby incorporated by reference.

Figure 6:
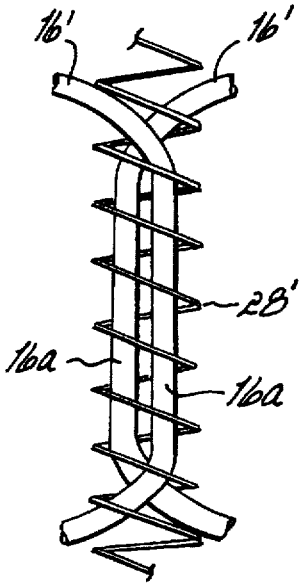
FIG. 6 is an enlarged view of the encircled portion 6—6 of FIG. 3.
Figure 7:
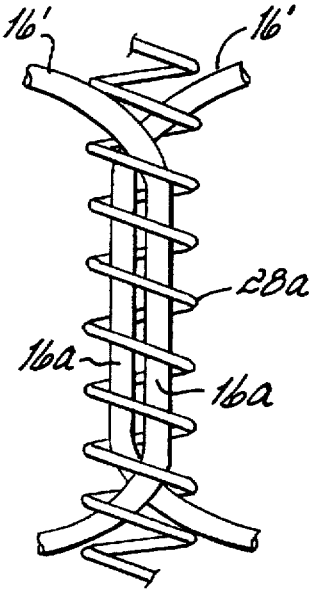
FIG. 7 is an enlarged view of the encircled portion 7—7 of FIG. 3.

In the preferred embodiment of the present invention, the helical lacing wires **28*a* in selected longitudinally extending regions or zones of the mattress spring core 20' are of a heavier gauge wire (see FIG. 7) as may be seen most clearly in a comparison of FIGS. 6 and 7 than the helical lacing wires 28' (FIG. 6) in other longitudinally extending regions or zones of the mattress spring core. The longitudinally extending zones of the mattress spring core having the heavier gauge helical lacing wires 28*a* are of greater firmness or rigidity than the longitudinally extending zones of the mattress spring core having helical lacing wires 28' of a lesser gauge. The spring core 20' can be divided up into any number of longitudinally extending zones or regions. However, the helical lacing wires in a particular longitudinally extending zone are identical so that the longitudinally extending zone has uniform firmness or rigidity within that zone. Any number of these longitudinally extending zones in which increased firmness is desired in the zone may be constructed with helical lacing wires 28*a* of a heavier gauge wire than the helical lacing wires in other longitudinally extending zones of the spring core assembly 20'**.

Figure 3:
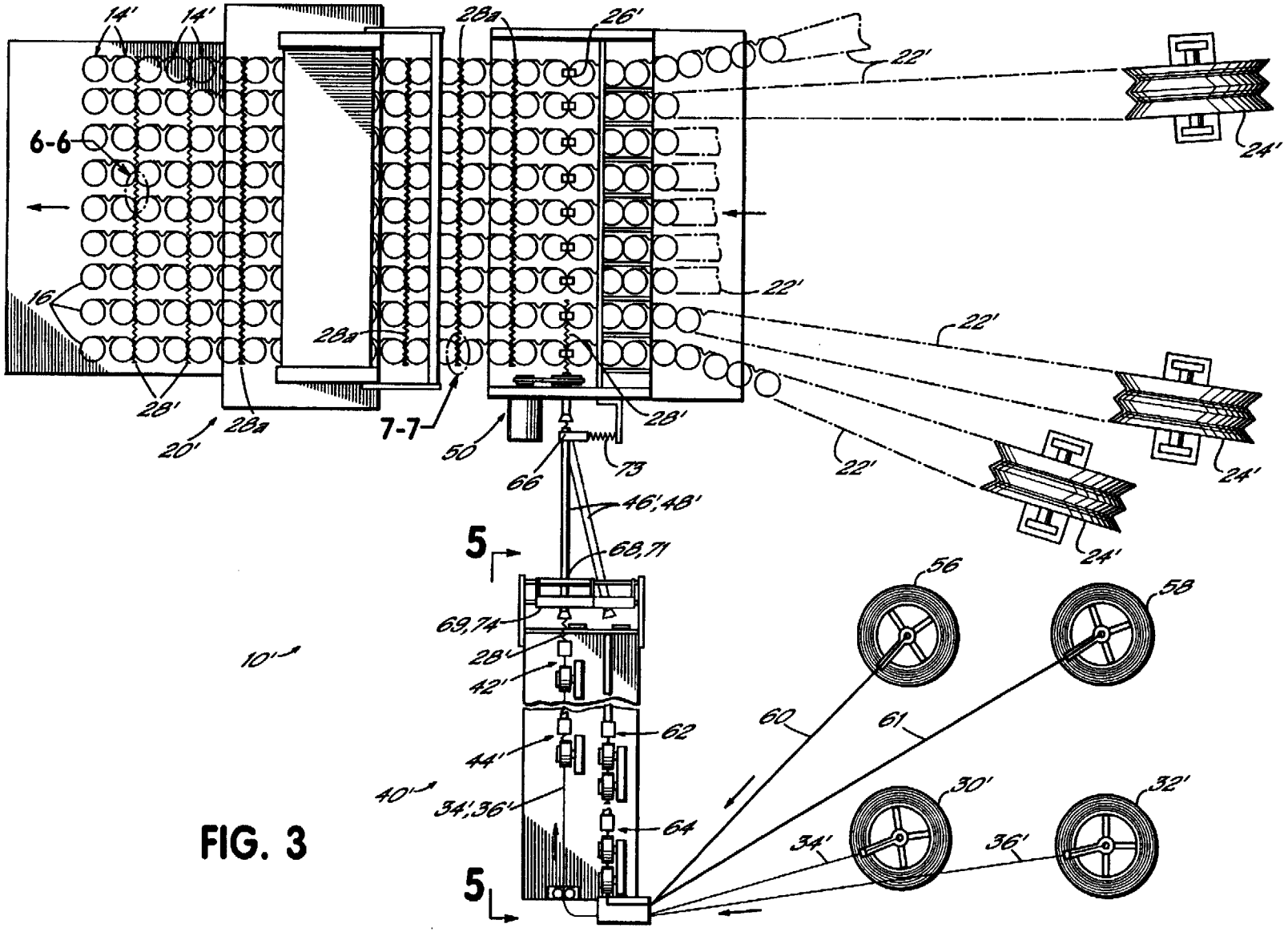
FIG. 3 is a top plan view of the coil spring assembly machine of this invention.
Figure 4:
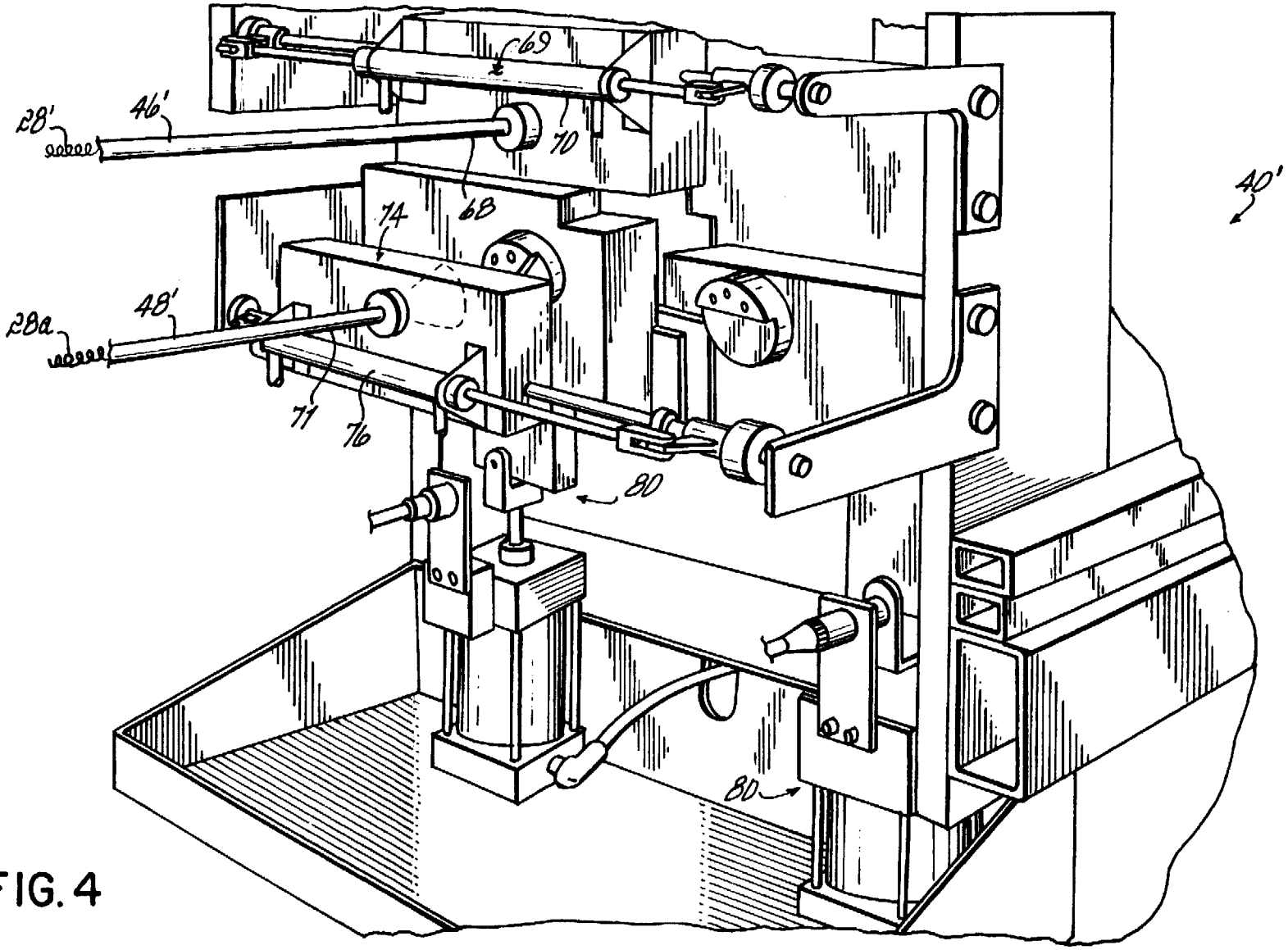
FIG. 4 is a perspective front elevational view of the lacing wire forming portion of the machine of FIG. 3.
Figure 5:
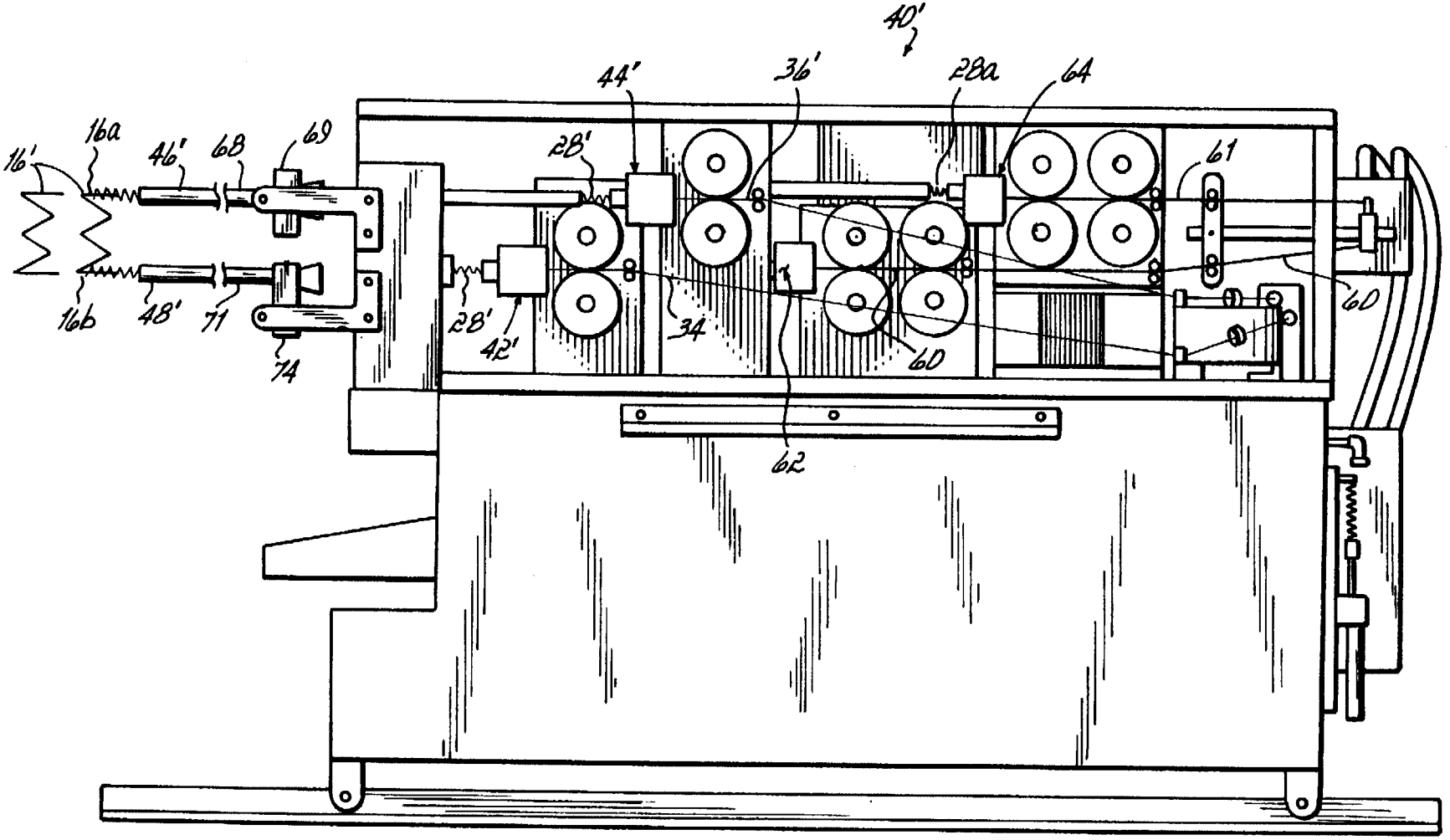
FIG. 5 is a side elevational view of the lacing wire forming portion of the machine of this invention.

The principal difference between the machine illustrated in FIGS. 1 and 2 and that illustrated in FIGS. 3, 4 and 5 is that the helical wire forming mechanism 40 of the machine made in accordance with the invention of this application has four forming heads 42', 44', 62, 64; two (44' and 64) for forming helical wires to be fed onto the top turns **16*a* or top portion of the springs 16' in the top plane of the spring core, and two (42' and 62) for forming helical wires to be fed onto the bottom turns 16*b* or portions of the spring 16' and used to joint the bottom turns or bottom portions 16*b* of the coil springs 16' in the bottom plane of the spring assembly. One of these forming heads 44' for forming helical wires in the top plane is operative to form light gauge wire 36', such as 17½ gauge in one preferred embodiment into a helical configuration, and the other forming head 64 is operative to form heavier gauge wire 61, such as 14½ gauge wire into the helical configuration in the top plane. Similarly, there are a pair of forming heads 42', 62 for forming both light gauge wire 32' and heavy gauge wire 60 into the helical configuration for supply to the spring unit in the plane of the bottom face 16*b* of the spring unit 20'**.

With reference now to FIG. 3, there are two pay-out reels 30', 32', illustrated for supplying both light gauge wire 34', 36' and two pay-out reels 56, 58 for supplying heavy gauge wire 60, 61 to the four forming heads 42', 44', 62 and 64 of the machine. The two forming heads 44', 64 form the light gauge wire 36' and the heavy gauge wire 61 into helical configurations to be supplied to t he top plane of the spring unit and the forming heads 42', 62 form the light gauge wire 34' and heavy gauge wire 60 with helical configurations to be supplied to the bottom planes of the spring unit. There is a single delivery tube 46', illustrated in FIGS. 3–5 for alternatively delivering both light gauge and heavy gauge helical lacing wires to the top plane of the spring unit. There is a second delivery tube 48' located beneath the delivery tube 46' for alternatively delivering both light gauge and heavy gauge helical lacing wires 28', 28*a* to the bottom plane of the spring unit.

With reference to FIG. 3, it will be seen that light gauge helical lacing wire 34' is supplied from the pay-out roll 30' to the helical former 42' where the relatively straight wire is formed into a helical configuration 28'. This helically formed wire 28' is then fed into the helical delivery tube 46'. Alternatively, and selectively, heavy gauge wire 61 may be paid from the pay-out reel 60 to the forming head 62 and converted by that forming head to a helical configuration 28*a* and supplied to the helical delivery tube 46' or 48'.

In order to selectively transport helically formed lacing wires 28', 28*a* from the forming heads 42', 62 to the auxiliary helical feed mechanism 50' in the top plane of the spring unit 20', the helical delivery tube 46' is mounted for pivotal oscillatory movement about an axis 66 between a first position whereat the input end 68 of delivery tube 46' is aligned with the discharge end of the forming head 64 and a second position whereat that same input end 68 is aligned with the discharge end of the forming head 44'. To effect this horizontal movement of the input end of the delivery tube 46', that end 68 of the tube is mounted in a slide 69 to which there is attached a double acting pneumatic cylinder 70. This cylinder is operative to move the slide 69 and thus the input end 68 of the delivery tube 46' between these two positions. In the preferred embodiment, this delivery tube 46' is spring-biased by a spring 73 to the first position in which the delivery tube is aligned with the discharge end of the helical former 42' of the light gauge wire.

It will now be readily apparent that a similar slide 74 and pneumatic cylinder 76 are operative to move the input end 71 of the second or lower delivery tube 48' between two positions in one of which it is aligned with the lower forming head 42' of the light gauge wire 34' in which position it accepts light gauge helical lacing wire from the lower light gauge wire former. In the second position, the lower delivery tube 48' accepts helical lacing wire 60 from a heavy gauge lacing wire former 62.

Figure 8:
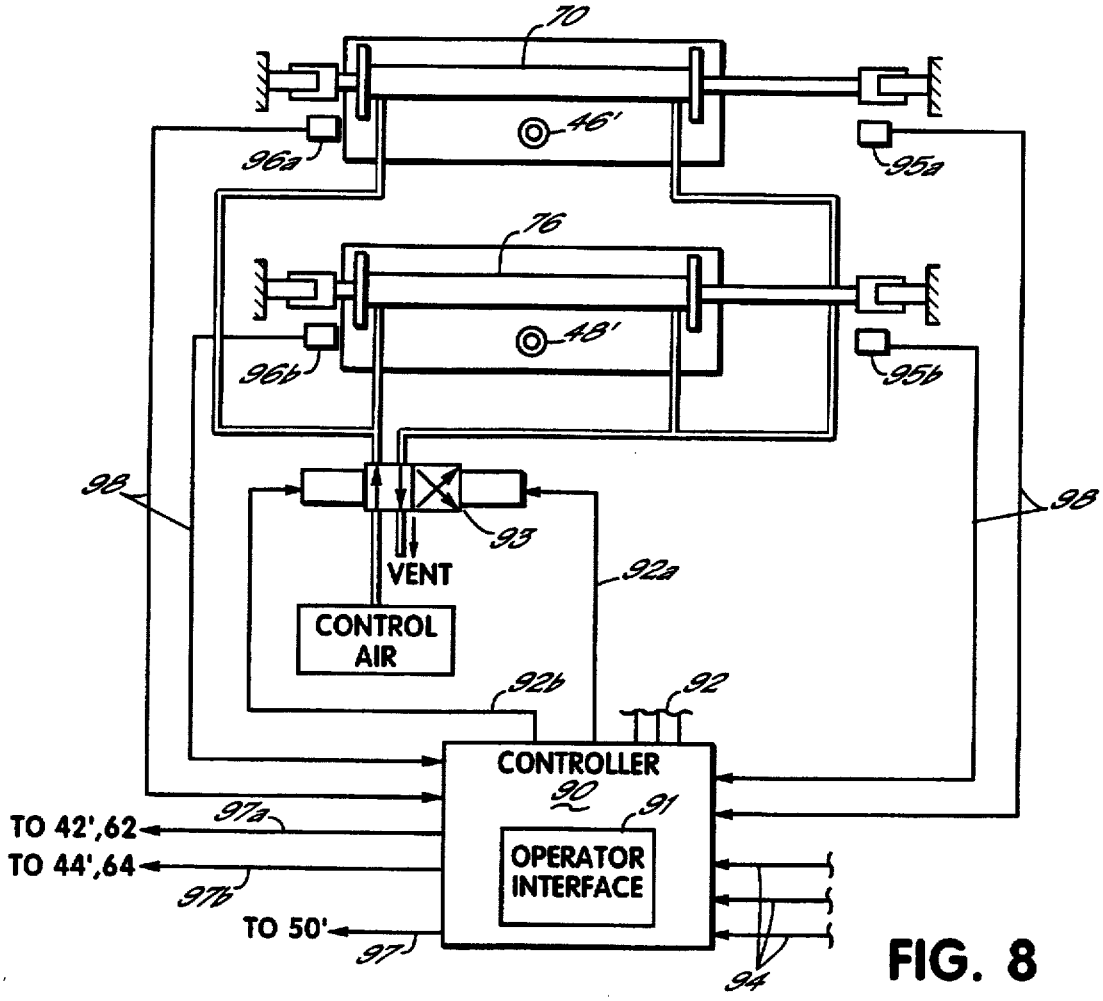
FIG. 8 is a diagram of a portion of the control system of the machine of FIG. 3.

The machine 10' includes a programmable controller 90 as illustrated diagrammatically in FIG. 8. The controller 90 includes an operator interface 91, such as a programmable touch screen through which an operator configures the operation of the machine 10' and through which machine status and other information are communicated to the operator. The controller 90 has a plurality of signal lines 92 connected to various controllable components of the machine 10'. The controller 90 also includes at least one output signal line 92*a*, or preferably on two lines 92*a*, 92*b*, connecting to a control input of the solenoid of a single or double acting solenoid controlled valve 93, which controls the double acting cylinders 70, 76 to move the delivery tubes 46', 48' between the two positions for the respective selective delivery of either the light or the heavy lacing wire.

The controller 90 also has a plurality of input lines 94 that connect from various controllable monitorable components of the machine 10', including the components that are part of the prior art machine or are otherwise not part of the preferred embodiment of the present invention. These input lines provide the controller 90 with information of the status of various machine components on which control functions may be conditioned. The controller 90 also includes signal lines 98 that are connected from sensors such as proximity switches 95, 95*b* that are actuated when the delivery tubes 46', 48' are in the proper positions for delivery of light gauge lacing wire, or switches 96*a*, 96*b* that are activated when the delivery tubes 46', 48' are in positions for delivery of the heavy gauge lacing wire.

In addition, two sets of output signal lines, line 97 and lines 97*a* and 97*b*, are provided to respectively control the operation of the lacing wire feeding mechanism 50' and the selective operation of either the respective light wire forming heads 42', 62 or the heavy wire forming heads 44', 64. The controller 90 conditions signals generated on output line 97*a* to the light wire forming heads 42', 62 on receipt of a signal from sensors 95, 95*b* verifying the presence of the tubes 46, 48' in their light wire delivery positions, and conditions signals generally on output line 97*b* to the heavy wire forming heads 44', 64 on receipt of a signal from sensors 96*a*, 96*b* verifying the presence of the tubes 46', 48' in their heavy wire delivery positions. Signals to the feeding mechanism 50' are conditioned on receipt of signals from either both sensors 95*a*, 95*b* or both sensors 96*a*, 96*b*.

The controller 90 stores settings that are set by an operator specifying the number of coil rows per each spring interior assembly unit and identifying the size of lacing wire desired in each lacing wire position of the spring interior assembly unit. The sizes of the lacing wire may be specified in any one of a number of ways. One contemplated way is for an operator to scroll down a list of lacing wire positions and for each position to set a switch between or among a list of desired lacing wire types. The settings would typically be made to assign, for example, light wire to each of a number of consecutive lacing wire positions in a first section of the unit, then heavy wire to each of a number of consecutive lacing wire positions of a second section of the unit, then finally light wire to each of a number of consecutive lacing wire positions of a third section of the unit. Such settings, once entered, can be stored under an identifying number for a particular spring assembly type and then recalled under that number upon the set-up of future jobs on the machine.

The same control logic can be employed for more than two types of lacing wire, with the tubes 46', 48' being pivotable, translatable or otherwise movable among more than two angular positions. In such cases, the cylinders 70, 76 and control valve 93, or some other control technique, would be used to positively switch among the plurality of positions.

While not illustrated and described herein, it will be appreciated by persons skilled in the art that the helical wire forming mechanism 40' includes cut-offs (not shown), actuated by pneumatic cylinders 80 for cutting off the helically formed lacing wire after it has been formed into a helical configuration of the appropriate length and delivered to the delivery tube 46'. Similarly, those skilled in the art will appreciate that the transfer and assembly machine 10' includes a twister located at the end opposite the delivery end or at both ends for twisting the ends of helical wires back upon themselves so as to prevent those wires from rotating off of the laced coil springs 16'.

Operation

In the operation of the transfer and assembly machine illustrated in FIGS. 3–8, rows of coil springs are intermittently moved from the rolls 24' of coil springs into the assembly machine. In the case of continuous springs, the springs are supplied from the rolls 24'. If the springs were discontinuous springs or conventional knotted or unknotted coil springs, the springs would be transferred into the assembly machine by a conventional transfer mechanism. Upon indexing of a laced row of coil springs and movement of the next following row of unlaced coil springs into the machine, the clamping dies 26' close and clamp the top and bottom turns of the coil springs of the unlaced coil springs within the dies. Once clamped, a helical lacing wire 28'or 28a stored in the delivery tube 46' or 48' is fed from the tubes into the helical path defined by the clamping dies. This feed of the helical lacing wire into this path is affected by the auxiliary helical feed mechanism 50'.

After a selected number of rows of springs have been laced by the light gauge helical lacing wire 28'formed in the helical wire former 42', the delivery tubes 46', 48' are shifted from the solid line position illustrated in FIG. 3 to the phantom line position illustrated in that figure. Thereat, heavy gauge helical lacing wire 28a from the helical wire former 62 and 64 is fed into the delivery tubes 46', 48'. With helical lacing wire located in these tubes, upon clamping of the next following row of coil springs, the heavy gauge lacing wire 28a is fed by the auxiliary helical feed mechanism 50' into and through the clamping dies 26' to secure that row of coil springs 14' together by means of the heavier gauge lacing wire 28a. This process is repeated according to a predetermined program until a programmed number of rows have been laced with heavy gauge helical lacing wire 28a. Thereafter, the helical delivery tubes 46', 48' are shifted back to the first position whereat those tubes are aligned with the light gauge helical former 42', 44' and the process repeated with light gauge helical lacing wire 28'. After a predetermined program of light gauge and heavy gauge springs have been applied to the spring unit 20', the connections between adjacent rows of a unit are severed by a conventional cutter of the assembly machine and the assembled spring unit fed out of the assembly machine.

The operating sequence described above is carried out under control of the controller 90. With the valve 93 in its normal position, preferably with a signal on line 92b, the cylinders 70, 76 are maintained by air controlled by the valve 93 in a position to hold the delivery tubes 46', 48' in the positions for delivery of, for example, light lacing wire 28, 28a, with sensors 95a, 95b being activated to verify the tube positions to the controller 90. This verification enables the signals on line 96a to activate the equipment to cause the feeding of the light lacing wire. After the selected number of rows of the light lacing wire have been fed, the controller 90, which is programmed to control and keep track of the indexing of the machine 10' and the counting of the rows of the unit that have been laced, signal line 92b is de-energized and line 92a is energized to move the tubes 46', 48' to the position for feeding heavy gauge wire. The movement of the tubes that results deactivates switches 95a, 95b as the tubes 46', 48' move from the light gauge wire positions and activates switches 96a, 96b as the tubes 46, 48 move into the heavy gauge wire positions. In response to the actuation of switches 96a, 96b, the controller 90 enables the heavy gauge wire forming and feeding components by way of signals on line 96b.

After the selected number of rows of the heavy lacing wire have been fed, the controller 90, counting the rows, de-energizes signal line 92a and energizes line 92a to move the tubes 46', 48' to the position for again feeding light gauge wire. The movement of the tubes that results deactivates switches 96a, 96b as the tubes 46', 48' move from the heavy gauge wire positions and activates switches 95a, 95b as the tubes 46', 48' move into the light gauge wire positions. In response to the activation of switches 95a, 95b, the controller 90 re-enables the light gauge wire forming and feeding components by way of signals on line 96a. The above cycle continues in accordance with the lacing wire program data that have been entered by the operator.

While we have described only a single preferred embodiment of the invention, persons skilled in this art will appreciate numerous changes and modifications which may be made without departing from the spirit of this invention. For example, instead of delivering wire of differing gauge to the forming stations of the helical wire forming mechanism, the pay-out rolls could deliver wire of the same gauge, but differing hardness or other physical characteristics to accomplish this same objective, i.e., having differing zones of the spring core laced with helical lacing wire of differing characteristics so as to create zones of differing firmness throughout the spring core. Furthermore, in lieu of shifting one end over each of the helical delivery tubes 46', 48' to connect the differing forming heads of the forming mechanism 40' with the input end of the helical feed mechanism 50', the complete forming mechanism 40' could be shifted to effect this alignment. These and other changes and modifications will be readily appreciated by persons skilled in the art to which this invention pertains. Accordingly, we do not intend to be limited except by the scope of the following appended claims.

We claim:

1. A coil spring assembly machine for lacing coil springs together to form a coil spring assembly, said coil spring assembly machine including clamping jaws for clamping together end portions of adjacent rows of coil springs in one of a top and bottom plane of said coil spring assembly, said clamping jaws including dies which cooperate with the end portions of said rows of coil springs to define a helical travel path for helical lacing wires as those lacing wires are moved through the said helical travel path; and a lacing wire forming and application mechanism for alternatively and selectively supplying lacing wires having two differing physical characteristics to said helical travel path.

2. The coil spring assembly machine of claim 1 wherein said lacing wire forming and application mechanism comprises a pair of wire pay-out reels, each of which reels supports wire of differing physical characteristics, a pair of helical wire formers for forming wire from each of said reels into a helical wire configuration, and a helical wire transfer mechanism for alternatively and selectively transferring wire from each of said helical wire formers into and through said helical travel path.

3. The coil spring assembly machine of claim 2 wherein said helical wire forming and application mechanism includes a feed tube for selectively receiving wire from each of said helical wire formers and means for moving at least one end of said feed tube between discharge ends of each of said formers while positioning an opposite end of said tube in alignment with an input end of said helical travel path.

4. The coil spring assembly machine of claim 2 wherein said helical wire forming and application mechanism includes a feed tube for selectively receiving wire from each of said helical wire formers and means for moving one end of said feed tube between positions of alignment with discharge ends of each of said formers while leaving an opposite end of said tube substantially stationary and in alignment with an input end of said helical travel path.

5. The coil spring assembly machine of claim 4 wherein said at least one end of said feed tube is an input end and said opposite end is a discharge end, said mechanism further including a helical wire feed mechanism for rotationally driving said helical wires into said helical travel path.

6. A coil spring assembly machine for lacing coil springs together to form a coil spring assembly, said coil spring assembly machine including clamping jaws for clamping together end turn portions of adjacent rows of coil springs in a top and bottom plane of said coil spring assembly, said clamping jaws including dies which cooperate with the end turn portions of said rows of coil springs to define a top and bottom helical travel path for helical lacing wires as those lacing wires are moved through the said top and bottom helical travel paths; and a lacing wire forming and application mechanism for alternatively and selectively supplying lacing wires having two differing physical characteristics to each of said helical travel paths.

7. The coil spring assembly machine of claim 6 wherein said lacing wire forming and application mechanism comprises two pairs of wire pay-out reels, each pair of which reels supports wire of differing physical characteristics, a pair of helical wire formers for forming wire from each of said pair of reels into a helical wire configuration, and a helical wire transfer mechanism for selectively transferring wire from each pair of said helical wire formers into and through one of said helical travel paths.

8. The coil spring assembly machine of claim 7 wherein said helical wire forming and application mechanism includes a pair of feed tubes for receiving wire from said helical wire formers and means for selectively moving at least one end of each of said feed tubes between discharge ends of each pair of said formers while positioning opposite ends of said tubes in alignment with input ends of said helical travel paths.

9. The coil spring assembly machine of claim 8 wherein said helical wire forming and application mechanism includes a pair of feed tubes for receiving wire from said helical wire formers and means for selectively moving one end of each of said feed tubes between alignment with a discharge end of one of said formers while leaving an opposite end of said tubes substantially stationary and in alignment with an input end of one of said helical travel paths.

10. The coil spring assembly machine of claim 8 wherein said at least one end of said pair of feed tubes is an input end and said opposite ends is a discharge end, said mechanism further including a helical wire feed mechanism for rotationally driving said helical wires into said helical travel paths.

11. A coil spring assembly machine for lacing coil springs together to form a coil spring assembly, said coil spring assembly machine including clamping jaws for clamping together end portions of adjacent rows of coil springs in one of a top and bottom plane of said coil spring assembly, said clamping jaws including dies which cooperate with the end portions of said rows of coil springs to define a helical travel path for helical lacing wires as those lacing wires are moved through the said helical travel path; and a lacing wire forming and application mechanism for alternatively and selectively supplying lacing wires of two different gauges to said helical travel path.

12. The coil spring assembly machine of claim 11 wherein said lacing wire forming and application mechanism comprises a pair of wire pay-out reels, each of which reels supports wire of differing gauge, a pair of helical wire formers for forming wire from each of said reels into a helical wire configuration, and a helical wire transfer mechanism for alternatively and selectively transferring wire from each of said helical wire formers into and through said helical travel path.

13. A method of operating a coil spring assembly machine for lacing coil springs together to form a coil spring assembly having longitudinal zones of differing firmness, which coil spring assembly machine includes clamping jaws for clamping together end portions of adjacent rows of coil springs in one of a top and bottom plane of said coil spring assembly, said clamping jaws including dies which cooperate with the end portions of said rows of coil springs to define a helical travel path for helical lacing wires as those lacing wires are moved from a lacing wire forming and application mechanism to and through the said helical travel path, which method comprises:

supplying two wires of differing physical characteristics to said lacing wire forming and application mechanism;

forming said two different wires into helical lacing wire configurations within said lacing wire forming and application mechanism; and alternatively and selectively supplying said lacing wires having two differing physical characteristics to said helical travel path so as to create an assembled coil spring assembly having lacing wires of two differing physical characteristics within said one of said top and bottom planes.

14. The method of claim 13 wherein said lacing wire forming and application mechanism includes a pair of wire pay-out reels, each of which reels supports wires of differing physical characteristics and a pair of helical wire formers for forming wire from each of said reels into a helical wire configuration, which method comprises:

transporting wire from each of said pay-out reels to one of said helical wire formers.

15. The method of claim 14 wherein said helical wire forming and application mechanism includes a feed tube for selectively receiving wire from each of said helical wire formers, which method further comprises:

moving one end of said feed tube between discharge ends of each of said formers while positioning an opposite end of said tube in alignment with an input end of said helical travel path.

* * * * *